United States Patent [19]

Huydts

[11] 4,343,236

[45] Aug. 10, 1982

[54] PRESTRESSED PRESS FRAME

[75] Inventor: Eduard J. C. Huydts, Düsseldorf-Gerresheim, Fed. Rep. of Germany

[73] Assignee: G. Siempelkamp GmbH & Co., Krefeld, Fed. Rep. of Germany

[21] Appl. No.: 239,024

[22] Filed: Feb. 27, 1981

[30] Foreign Application Priority Data

Mar. 1, 1980 [DE] Fed. Rep. of Germany ..... 3007975

[51] Int. Cl.[3] ..... B30B 15/04

[52] U.S. Cl. ..... 100/214; 72/455; 425/DIG. 26

[58] Field of Search ..... 100/214; 425/DIG. 26; 72/455; 83/859

[56] References Cited

U.S. PATENT DOCUMENTS

| | | | |
|---|---|---|---|
| 3,064,558 | 11/1962 | von Platen | 100/214 |
| 3,643,592 | 2/1972 | Blaser | 100/214 |
| 3,717,024 | 2/1973 | Davison | 100/214 |
| 3,884,142 | 5/1975 | Jonsson | 100/214 |

FOREIGN PATENT DOCUMENTS

| | | | |
|---|---|---|---|
| 2818511 | 6/1979 | Fed. Rep. of Germany | 100/214 |
| 1305712 | 2/1973 | United Kingdom | 100/214 |

*Primary Examiner*—Billy J. Wilhite

*Attorney, Agent, or Firm*—Karl F. Ross

[57] ABSTRACT

A press frame, comprising an upper or head plate, a lower or bed plate and a plurality of posts fitted between the head plate and bed plate of the frame, is provided with tension member, e.g. cables or bands, extending around the frame and lying in successive vertical planes spaced apart horizontally along the frame. According to the invention, the cables or bands, which are slung around the head and bed of the frame and have a U-shaped pattern as they pass therearound, are alternately offset horizontally to one side and to the other so that the tension cross sections within the cables or bands in the respective planes are likewise offset alternately from side to side. The tension elements have their ends connected to stressing units alternately on one side and the other of the press and lying in chambers formed in the posts. The units interconnect ends of the outer tension elements in each chamber.

5 Claims, 5 Drawing Figures

PRESTRESSED PRESS FRAME

FIELD OF THE INVENTION

My present invention relates to a prestressed press frame and, more particularly, to heavy presses for use in high pressure technology in which the press frame is subjected during operation to considerable loading.

BACKGROUND OF THE INVENTION

A heavy press for high pressure technology can comprise an upper plate or head plate (head) of the press having an upwardly convex cross section, a lower plate or bed plate (bed) of downwardly convex cross section, a pair of posts between the bed and the head, the frame structure being prestressed against forces developed during press operation by tension members which extend in arcuate patterns around the head and bed and have linear sections lying along the posts.

The tension member can be cables whose opposite ends are held together by stressing or tensioning units, such as hydraulic cylinders, turnbuckles or the like, and the cables can lie in grooves formed in the head, bed and posts.

In general the arcuate bights of the cables along the head and bed are identical and have the configuration of a downwardly open U and an upwardly open U respectively.

Each of the cables applies its prestressing force in a substantially vertical plane and within this plane the space surrounded by the cable forms a stressing section, the stressing sections for all the cables being substantially identical.

A system of this type has been described in German Patent DE PS 28 18 511, FIG. 3, and in this arrangement the tension members cross one another in or on the head of the press.

When this prestressed frame construction is used in heavy presses for high pressure technology, an especially large number of cables and the respective stressing units must be provided to enable the forces to be adequately withstood. It has been difficult if not impossible to provide an adequate number of such cables in presses for certain purposes.

Furthermore, the crossing configuration of the cables tends to place an undue stress on them which might limit the ability of the stressing system to withstand the press-generated forces.

OBJECTS OF THE INVENTION

It is the principal object of the present invention to provide an improved press frame whereby the disadvantages of prior art systems are obviated.

Another object of this invention is to provide a prestressed press frame, especially for heavy presses in high pressure technology, which is more readily able to withstand the high pressing forces than earlier systems.

Still another object of this invention is to provide a stressing system for a press of the type described in the aforementioned publication but which can be more easily accommodated and which allows a greater number of stressing cables or bands to be applied than has heretofore been the case.

Yet another object of the invention is to provide a system for the purposes described which can accommodate an especially large number of tension elements in equidistant relationship without difficulties arising from the presence of stressing units for each of the cables or bands.

SUMMARY OF THE INVENTION

These objects and others which will become apparent hereinafter are attained, in accordance with the present invention, by providing a press frame of the type described, i.e. with a head, bed and post arrangement as mentioned wherein the tension members lie in respective vertical planes perpendicular to the longitudinal horizontal dimension of the press, spaced apart horizontally in this direction, have their stressing units disposed alternately on one side and on the opposite side of the press in succession in this direction, and each of the cables or bands tension members in a given vertical plane defines a stressing section within this cable or band in which internal prestressing force is applied to the frame.

These stressing sections, bound by the cables, are offset alternately horizontally to one side and to the other side for the successive sections in the aforementioned direction.

According to an important aspect of the invention, the stressing units are received in chambers formed along the opposite sides of the press frame, e.g. as outwardly oppositely open recesses form in the posts, the stressing units connecting the ends of the cables which lie outermost in each chamber.

While the terms "cable" and "band" have been used herein practically interchangeably with the term "tension member" to refer to the flexible element extending around the frame in the plane of each stressing section, it will be understood that each stressing section can be defined by any flexible tension member in the form of a wire, steel band, strap, etc. The stressing units can be turnbuckles, hydraulic piston-and-cylinder arrangements, nut and bolt tightening arrangements or any other arrangement capable of maintaining the cable under tension, preferably after the tension force has been applied, by the locking of mechanical members.

The ends of the cables or straps may be formed with coined enlargements to enable the units to grasp them or with eyes or the like.

The system of the present invention has been found out to be highly effective in enabling a large number of tension members to be accommodated in succession along the press frame without mutual interference between the stressing units.

Consequently this system can be used for heavy presses in high pressure technology in which the forces applied to the frame are significantly greater than have been accommodated by cable stressing systems heretofore.

The number of stressing elements can be proportioned to the specific loading of the press frame and it is also possible in accordance with the present invention to substitute for an equidistant spacing, a spacing which varies over the length of the press to accommodate this specific loading distance therealong. It is also possible to accommodate the different specific loadings along the press by stressing some of the cables to a greater extent than others if the cables are uniformly spaced or to combine a variable stressing along the press line with a varying spacing of the tension members.

Since the greatest stress is found in the middle of the press the cross sections of the tension members in this region may be greater than the cross sections toward the opposite ends of the press.

Naturally, the members of the press frame can also have different cross sections, e.g. increasing toward the center of the press.

BRIEF DESCRIPTION OF THE DRAWING

The above and other objects, features and advantages of the present invention will become more readily apparent from the following description reference being made to the accompanying drawing in which.

SPECIFIC DESCRIPTION

Figure 1:
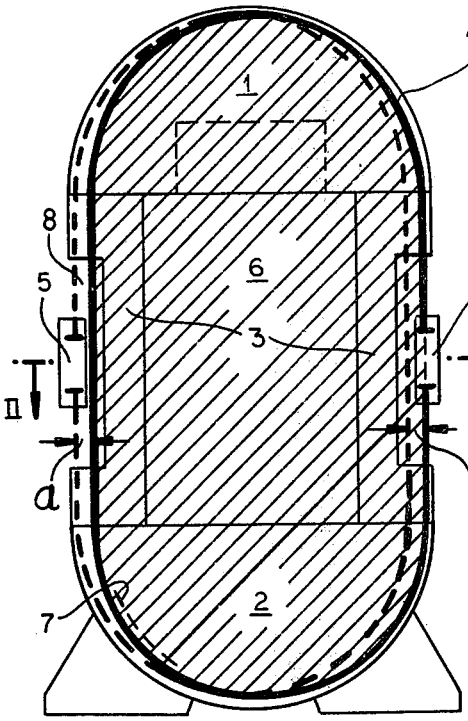
FIG. 1 is a diagrammatic cross section taken along the line I—I of FIG. 2 and a vertical plane corresponding to the plane of the stressing section of one of the cables or bands offset to the right side of a press according to the invention.
Figure 3:
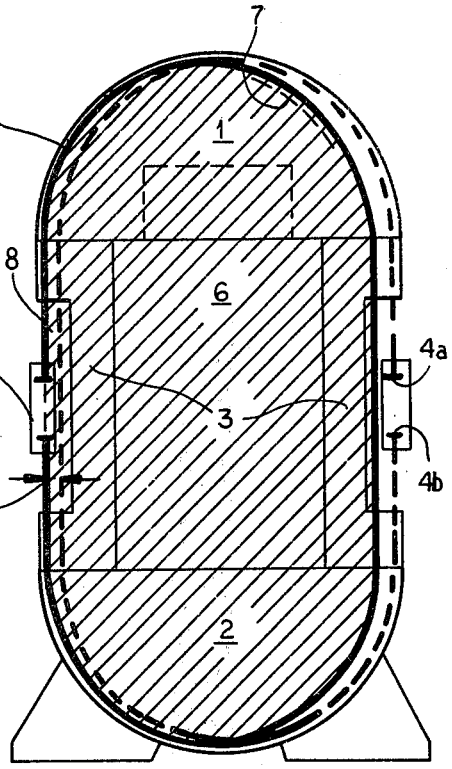
FIG. 3 is a sectional view similar to FIG. 2 but taken along the line III—III of FIG. 2 in a plane of a stress section offset to the left side of the press.
Figure 2:
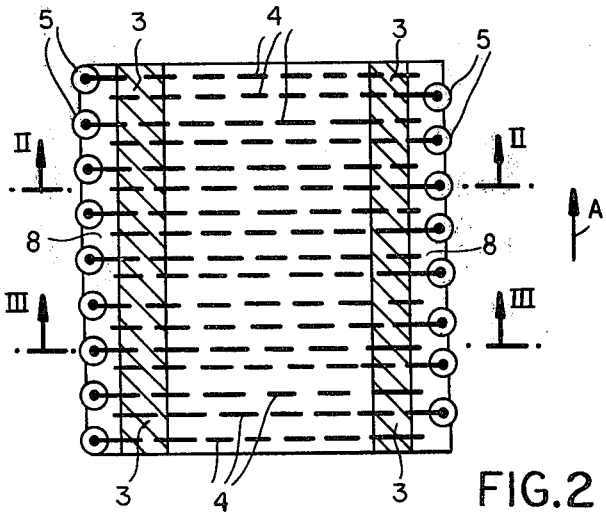
FIG. 2 is a diagrammatic section taken along the line II—II of FIG. 1.

The press frame shown in FIGS. 1 through 3 basically comprises an upper plate beam or head 1, a lower plate or bed 2 and, on each side of the press, a pair of posts 3 (FIG. 2) which extend to full length of the press. The assembly 1, 2, 3 is held under inward prestress by tension members 4 which can be cables (FIG. 4) or bands (FIG. 5), maintained under tension by the stressing units 5.

Figure 4:
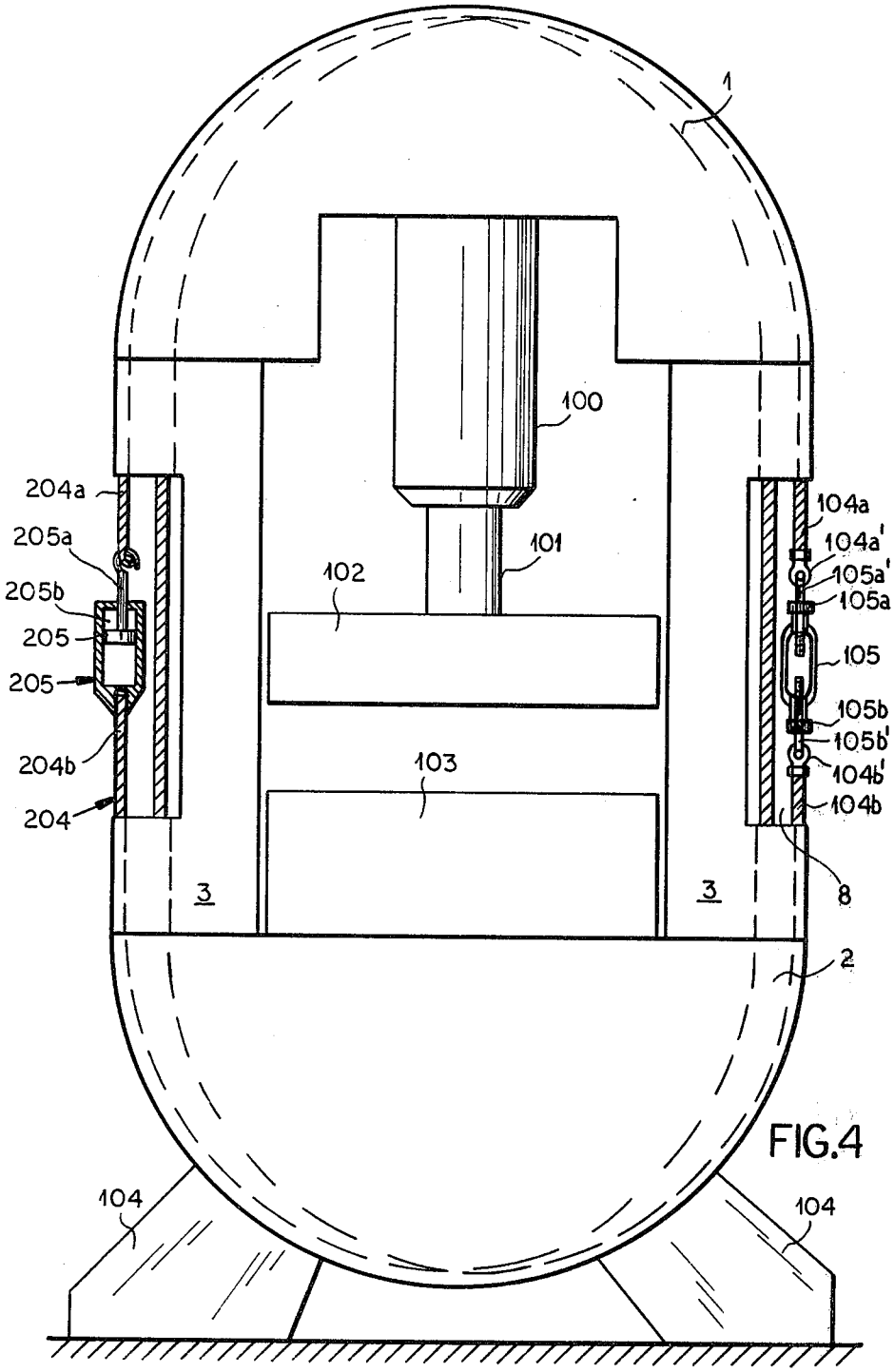
FIG. 4 is an end view of the press.
Figure 5:
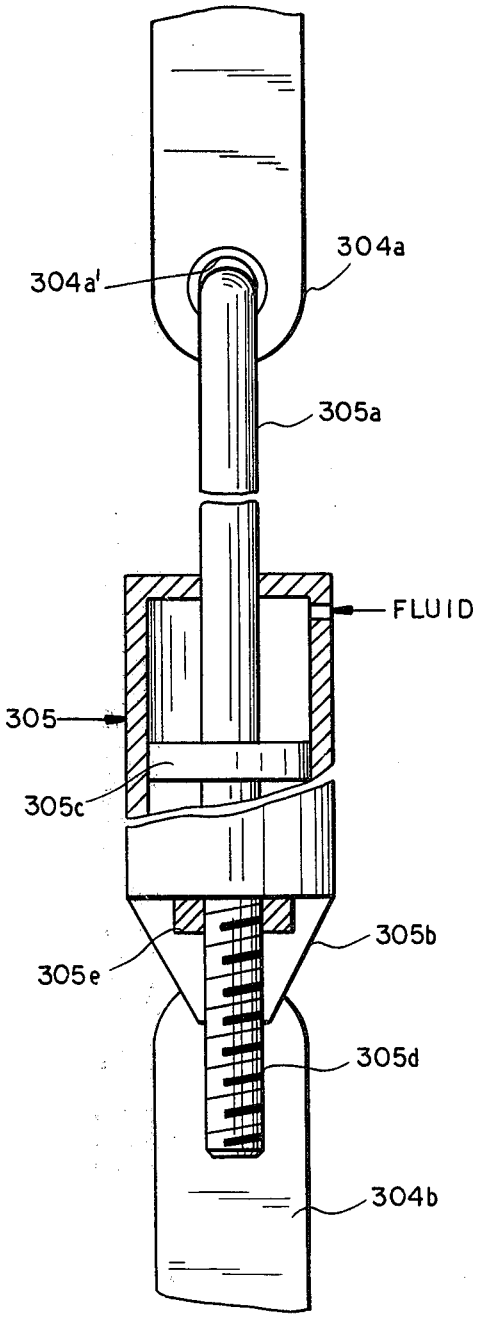
FIG. 5 is a sectional view illustrating another stressing unit for tension member types shown in FIGS. 1 through 4.

According to the invention, the stressing members 4 are spaced apart in the longitudinal direction (arrow A in FIG. 2), horizontally and lie in respective vertical planes, each stressing member 4 having its free ends 4*a* and 4*b* which can be enlarged or coined as shown in FIG. 3, drawn together by respective stressing unit 5 diagrammatically shown in FIGS. 1 and 3 but which can have any of the configurations of FIGS. 4 and 5.

Because of the upwardly and downwardly convex construction of head 1 and the bed 2, and the correspondingly arcuate groups 7 formed therein to accommodate the tension members 4, the tension members have downwardly open and upwardly open U-patterns where they overlie and underlie the head and bed respectively, each tension member 4 thus is of double U-shape.

The assembly is so arranged that each tension member 4 encloses substantially the same stressing cross section 6, i.e. the cross section 6 hatched in FIGS. 1 and 3 and which represents the area in which force can be generated to be absorbed or taken up by the tension member. According to the invention, the stress sections 6 for each of the tension members 4 are identical and the beds 7 for these members are so arranged alternately that the sections 16 lie alternately from one side to the other for the successive sections in the direction of arrow A, the stress section in FIG. 1, for example, offset at the right side of the press and the stress section 6 of FIG. 3 offset at the left side of the press.

The degree of offset is indicated at a. The tension members 4, in the region of the posts 3, extend through outwardly open members 8 and, in each member, the stressing unit 5 joins the ends of the relatively outermost tension member again.

The press structure can be seen in greater detail in FIG. 4 to include one or more lydraulic cylinders 100 whose pistons 101 act upon the upper press member 102 which can apply pressure to a workpiece (not shown) on a lower die or press member 103. The member 103 can rest upon the bed 2 of the press which is supported on legs 104 while the cylinders 100 are mounted on the head 1. In the embodiment shown in FIG. 4, the stressing unit between the ends of the cable 104*a*, 104*b* is a turnbuckle 105, provided with locking nuts 105*a* and 105*b* which, once the desired tension is generated, can be tightened to maintain this tension. The threaded rods of the turnbuckle 105*a'* and 105*b'* are here shown to engage in eyes 104*a'* and 104*b'* of the cable ends 104*a*, 104*b*.

Another stressing unit is shown at 205 in FIG. 4 and can comprise a cylinder which is connected to one end 204*b* of a cable 204 while the other end 204*a* of this cable is connected to the piston rod 205*a* of a piston 205. The stress is applied by hydraulically pressurizing the compartment 205*b* and then sealing this compartment.

In FIG. 5 I show another device 305 for applying stress to the tension member, here a steel band, whose ends 304*a*, 304*b*, are provided with eyes such as has been shown at 304' for connection to a hook of the piston rod 305*a* and a hook not shown connected to the cylinder housing 305*b*. In this embodiment, the piston 305*c* carries a thread rod 305*d* which can be locked in place by a nut 305*e* after the desired tension is applied to provide a mechanical system for locking the tension member under the desired tension stress. Any conventional units for this purpose may be employed.

I claim:

1. A prestressed press frame comprising:

an upwardly complex head;

a downwardly complex bed underlying and spaced from said head, said bed and said head extending in a common direction;

at least a pair of posts disposed between said bed and said head on opposite sides of the frame, said posts being formed with outwardly open compartments;

a multiplicity of tension members extending around said bed and said head in a double-U pattern and passing through said compartments, each of said tension members lying in common vertical plane perpendicular to said direction, said tension members being spaced apart in said direction, each tension member defining in the respective plane a stress section, the press sections of alternate tension members in succession in said direction being offset to one side and the other side of said frame; and a respective stressing unit connecting opposite ends of each tension member and applying tension thereto, the stressing units for successive tension members in said direction being received in said compartment on alternate sides of said frame with the stressing units always engaging the ends of outermost tension members in said compartment.

2. The press frame defined in claim 1 wherein said tension members are cables.

3. The press frame defined in claim 1 wherein said tension members are steel bands.

4. The press frame defined in claim 1, claim 2 or claim 3 wherein each of said stressing units is provided with mechanical means for locking the ends of the respective tension member in place upon the application of a predetermined tension thereto.

5. The press frame as defined in claim 4 wherein each of said stressing units is a lockable hydraulic piston and cylinder arrangement.

* * * * *